United States Patent [19]

Eschner

[11] Patent Number: 4,631,074

[45] Date of Patent: Dec. 23, 1986

[54] METHOD AND APPARATUS FOR REDUCING THE TEMPERATURE OF AIR

[75] Inventor: Axel Eschner, Wiesbaden, Fed. Rep. of Germany

[73] Assignee: Didier-Werke AG, Wiesbaden, Fed. Rep. of Germany

[21] Appl. No.: 445,474

[22] Filed: Nov. 30, 1982

[30] Foreign Application Priority Data

Dec. 15, 1981 [DE] Fed. Rep. of Germany ..... 3149672

[51] Int. Cl.[4] ..... B01D 53/04

[52] U.S. Cl. ..... 55/27; 55/31; 55/33; 55/74; 55/75; 55/208; 55/387; 55/389

[58] Field of Search ..... 55/27, 28, 30, 31, 33–35, 55/74, 75, 179, 180, 208, 387, 389

[56] References Cited

U.S. PATENT DOCUMENTS

| | | | |
|---|---|---|---|
| 2,675,089 | 4/1954 | Kahle | 55/180 X |
| 2,790,505 | 4/1957 | Dow | 55/33 |
| 3,190,343 | 6/1965 | Hussmann | 55/35 X |
| 3,230,689 | 1/1966 | Hussmann | 55/31 X |
| 3,674,429 | 7/1972 | Collins | 55/31 X |
| 3,844,737 | 10/1974 | Macriss et al. | 55/34 |
| 3,981,698 | 9/1976 | Leppard | 55/31 |
| 4,030,896 | 6/1977 | Wimber et al. | 55/33 |
| 4,054,428 | 10/1977 | Foltz | 55/33 |
| 4,183,734 | 1/1980 | Leppard et al. | 55/28 |
| 4,185,969 | 1/1980 | Bulang | 55/31 |
| 4,227,375 | 10/1980 | Tompkins et al. | 62/2 |
| 4,336,159 | 6/1982 | Winter | 55/27 X |
| 4,398,927 | 8/1983 | Asher et al. | 55/35 X |

FOREIGN PATENT DOCUMENTS

| | | | |
|---|---|---|---|
| 882541 | 7/1953 | Fed. Rep. of Germany | 55/179 |
| 974410 | 12/1960 | Fed. Rep. of Germany . | |
| 2844935 | 8/1982 | Fed. Rep. of Germany . | |
| 283470 | 7/1929 | United Kingdom . | |
| 331824 | 7/1930 | United Kingdom . | |
| 1052255 | 12/1966 | United Kingdom . | |
| 1152439 | 5/1969 | United Kingdom . | |
| 1329899 | 9/1973 | United Kingdom . | |
| 1526749 | 9/1978 | United Kingdom . | |
| 709138 | 1/1980 | U.S.S.R. | 55/208 |

*Primary Examiner*—Robert Spitzer

*Attorney, Agent, or Firm*—Wenderoth, Lind & Ponack

[57] ABSTRACT

The temperature of humid environmental air is reduced by passing the air, in a first stage, through a moisture storage agent and therein substantially freeing the air of the moisture content thereof. In a second stage, the air is passed through a heat storage agent and therein the temperature of the air is lowered without changing the humidity thereof. In a third stage the thus dried and cooled air is passed through a moisturizing system, and therein the moisture content of the air is increased and the temperature of the air is further lowered.

6 Claims, 4 Drawing Figures

METHOD AND APPARATUS FOR REDUCING THE TEMPERATURE OF AIR

BACKGROUND OF THE INVENTION

The present invention relates to an air conditioning or climate control method and apparatus involving the use of water absorbing and desorbing storage agents or mediums. More specifically, the present invention is directed to such a method and apparatus for reducing the temperature of air, for example humid environmental air, for uses such as in air conditioning buildings or rooms during hot times of the year.

It is known that for the evaporation of water or the desorption of water from a water saturated moisture storage agent or medium, such as a siccative, for example zeolite or silica gel, a considerable amount of heat is necessary. If such desorption occurs adiabatically, that is without the addition of exterior heat to the water or to the storage agent, then the heat required for the desorption and/or evaporation has to be taken from other sources, for example from dry air which, with the adiabatic technique, is caused to flow through the water or storage agent and thereby is saturated with water vapor.

SUMMARY OF THE INVENTION

With the above discussion in mind, it is the object of the present invention to provide a method and apparatus for reducing the temperature of air, for example humid environmental air, which invention utilizes the absorption of water vapor by dry air from water or a water saturated moisture storage agent It is a further object of the present invention to provide such a method and apparatus whereby it is possible to achieve a considerably improved air conditioning affect through a particular manner of carrying out the method.

Water sorption by moisture storage agents or mediums can be reflected through the following general equation:

$$AB + heat \rightleftharpoons A + B$$

whereby, A represents the moisture storage agent in a dry condition, B represents water vapor in the air, and AB represents the moisture storage agent saturated with water vapor.

The present invention makes particular use of the phenomenon that even at relatively low temperatures desorption of water from moisture storage agents is possible, thereby resulting in a lowering of the temperature of the air. The expression "relatively low temperatures" as employed herein refers to temperatures occurring under normal conditions, for example temperatures below 40° C. and preferably below 30° C., i.e. temperatures which normally have not been used for the desorption of water from water saturated storage agents such as zeolite or silica gel.

These objects are achieved in accordance with the present invention by the provision of a method and apparatus for reducing the temperature of air, such as humid environmental air, by, in a first stage, passing the air through a moisture storage agent and therein substantially freeing the air of the moisture content thereof. During this first stage, the temperature of the air is increased. In a second stage, the air is passed through a heat storage agent and transfers heat to such heat storage agent without causing any change in the moisture content of the air. In a third stage the air is passed through a moisturizing system, for example water or a water saturated moisture storage agent, and therein increasing the moisture content of the air and further lowering the temperature thereof.

In accordance with the present invention, it initially is necessary to transform the environmental air into dry air which thereafter is capable of taking up water vapor either from water or a water saturated moisture storage agent. This enables the temperature of the air to be reduced considerably more than would be possible if the environmental air, containing some moisture content, were simply to be passed through the water or water saturated moisture storage agent. During a first stage in accordance with the present invention, air from the particular environment involved, which has an arbitrary or particular degree of humidity, is dried substantially completely with the aid of a dry moisture storage agent or medium. Air from the environment rarely has a degree of humidity less than approximately $r=30\%$. During warm times of the year, the normal humidity content of the air may be at 50 to 70% relative humidity. As employed herein, the term "humid environmental air" may refer to air from a particular environment having a moisture content, but such term particularly is intended to refer to environmental air prevailing during warm times of the year. Such term also may include relatively dry air on hot summer days having a humidity value as low as $r \geqq 30\%$.

When drying humid environmental air by means of a dry moisture storage agent or medium, heat is released so that the temperature of the dried air leaving the moisture storage agent is considerably higher than it was upon entering. During a second stage of the invention, the higher temperature of this dried air leaving the moisture storage agent is reduced in a so-called heat fill or heat storage agent or medium. By this second stage, the temperature of the air is lowered to a value which generally is no higher than that of the humid environmental air before it enters the moisture storage agent in the first stage. As will be explained in more detail below, it is particularly advantageous to use in the second stage a heat storage agent which initially has a temperature lower than that of the humid environmental air originally entering the moisture storage agent in the first stage. It is of advantage to achieve this lower temperature of the heat storage agent by sufficiently flushing the heat storage agent with so-called "night air" during the night, i.e. at a time when the environmental temperature is considerably lower than during the day. As a result, the heat storage agent is provided with a temperature which is lower than that which prevails during the day when an air conditioning operation is to take place. The humid environmental air which is conditioned during the day has a higher temperature than the "night air" used to cool or regenerate the heat storage agent.

Thus, the air which is dried by the moisture storage agent during the first stage has its temperature lowered by the heat storage agent in the second stage, the dried air giving off heat which is absorbed by the heat storage agent during the second stage, and the air leaves the second stage at a reduced temperature. Such reduced temperature generally is no higher than the original temperature of the humid environmental air, and preferably is even lower. The heat fill or heat storage agent has the quality of not changing the atmospheric humidity or moisture content of the air during the second stage, and has only a relatively low heat conductivity. Preferred materials for such heat fill or heat storage agent are olivine or basalt materials which have a relatively high heat capacity but a relatively low heat conductivity.

After passage of the air through the second stage, such air being substantially dry and at a relatively low temperature which generally is no more than that of the temperature of the original humid environmental air, the air then is passed through a third stage and is humidified and further cooled. In accordance with a first embodiment of the present invention, during the third stage the dried cooled air from the second stage is either conducted through water, which has the temperature of the surrounding area or that of tap water, or is brought in contact with water through a suitable apparatus such a washing tower or a column filled with Raschig rings, so that the previously dried air again is humidified, for example saturated with water vapor. As a result of the manner in which this technique is carried out, adiabatic if possible, the temperature of the air is reduced further.

In accordance with a second embodiment of the third stage in accordance with the present invention, the dried and cooled air leaving the second stage is passed through a water saturated moisture storage agent or medium and absorbs therefrom water. That is, in accordance with this embodiment of the third stage, a desorption process takes place even though the air already is at a relatively low temperature. During this desorption process, additional heat is removed from the air so that the temperature of the air is reduced further.

It is to be understood that a precondition for carrying out the present invention is that the individual containers or structures which hold the moisture storage agent of the first stage, the heat storage agent of the second stage, and the water or water saturated moisture storage agent of the third stage are operated in a manner which is as adiabatic as possible, i.e. that such containers have sufficient insulation so that the air conditioning effects discussed above and achieved in accordance with the present invention are not thwarted by parasitic heat flow from the exterior.

The humidified and reduced temperature air which leaves the third stage can itself be used to air condition rooms, i.e. such air can be blown directly into rooms for cooling purposes. On the other hand, it also is possible to employ the low temperature of such air in a heat exchanger so that such air indirectly cools other agents.

It is desirable to employ columns as the containers which hold the various agents or elements of the three stages in accordance with the present invention. By so employing columns, it is possible to achieve in each column of each stage a function front or interface which extends across each column and which moves along each column during use of the respective stage. More specifically, in the case of the use of the moisture storage agent in a column in accordance with the first stage, a step function front or interface moves through the moisture storage agent in the flow direction, and such front represents an interface between the original dry moisture storage agent and humid moisture storage agent, the quantity of which progressively increases during continued use of the first stage. Similarly, in the case of the second stage, there is formed in the heat storage agent across the column thereof a function front or interface moving along the direction of flow of the air and beween higher temperature agent and lower temperature agent. Finally, in a third stage employing an originally water saturated moisture storage agent, there is formed a function front or interface through such agent and moving in the direction of the flow of the air, such front being between dried agent and water saturated agent.

It is to be understood that the individual amounts of the moisture storage agent in the first stage, the heat storage agent in the second stage and the water saturated moisture storage agent in the third stage are provided in a coordinated manner so that the "cooling capacity" existing in the heat storage agent of the second stage is used up only when the moisture storage agent of the first stage is entirely saturated with water as a result of the flow therethrough of the most unfavorable humid environmental air, i.e. such air having the highest possible relative humidity, and/or when a water saturated moisture storage agent is employed in the third stage and such agent has all of the water removed therefrom and thus cannot cause any further lowering of the temperature of the air. With a suitable arrangement, for example in the columns discussed above, the individual function fronts which pass through the stages move through the individual columns at a relative width. In general, the ratio of the length to the width and/or the diameter of such columns should be 1.5:1 to 8:1, preferably 2:1 to 4:1.

For practical purposes, the equipment used in accordance with the present invention is designed so that it can meet the maximum air conditioning requirements of a particularly hot day at a given planned location. During the night, the heat storage agent or medium again can be cooled down or regenerated by passing therethrough so-called "night air" so that such heat storage agent will be at a lower temperature level on the following day when it again is needed for air conditioning purposes. Preferably, the initial temperature of the heat storage agent should be lower than the temperature of the humid environmental air which is fed into the system during the day.

In order to achieve drying or regeneration of the moisture storage agent in stage one, i.e. after such agent has become saturated with water during use, air may be passed through such agent. It is necessary to increase the temperature of such air used for this regeneration process with a heating system, for example an electric heating system or heat exchanger, so that the water saturated moisture storage agent of the first stage is dried so that it may be used again. When using silica gel as the moisture storage agent, regeneration air temperatures of less than 100° C. have proved to be sufficient. Thus, a regeneration air temperature of 80° C. is sufficient with a starting air temperature at 30° C. and 100% relative humidity, and a regeneration air temperature of 70° C. is sufficient with starting air at a temperature of 30° C. and relative humidity of 50%.

In accordance with one preferred embodiment of the present invention, the heat which is stored in the heat storage agent of the second stage during an air conditioning operation, i.e. generally during the day, is used to regenerate water saturated moisture storage agent of the first stage. To do this, air is fed through the heat storage agent of the second stage in a direction reverse to the flow direction employed during an air conditioning operation. This air takes up heat stored in the heat storage agent, and following possible further heating up of such air to that temperature required for regeneration of the agent of the first stage, as described above, the air at a sufficient temperature flows through the moisture storage agent of the first stage in a direction opposite to the flow direction during an air conditioning operation. By this arrangement, the moisture storage agent of the first stage is regenerated, i.e. is dried so that the water which saturated such agent during the previous air conditioning operation is removed. It of course is to be understood that temperatures above 100° C. also can be used during such regeneration process, for example in the case of difficult to dry zeolites or to achieve a particularly fast drying of the moisture storage agent.

When using a moisture agent or medium in the third stage of the present invention, it also is possible to change the flow direction of the air at night to achieve regeneration. That is, night air which is relatively cool and which has a relatively high degree of humidity may be fed into the moisture storage agent of the third stage which has become, during the previous air conditioning operation, substantially freed of water and therefore dried. This air flowing through the agent in the third stage releases moisture to the agent, and the agent thus becomes again saturated with water so that the agent of the third stage again is ready for a new air conditioning operation. This air leaves the agent of the third stage at a somewhat higher temperature and then may be fed into the heat storage agent of the second stage which was used during a previous air conditioning operation and which thus is at a higher temperature. Such air passes through the heat storage agent, thereby cooling the heat storage agent, and when the air leaves such heat storage agent it is at a much higher temperature. Such air then may be further heated with the aid of an additional heat source to the necessary temperature required to regenerate the moisture storage agent in the first stage which at that time is saturated with water due to a previous air conditioning operation. Passage of such air through the moisture storage agent of the first stage dries such agent completely or substantially completely, and thereby the entire system is regenerated so that a new air conditioning cycle may be commenced.

In accordance with one particular arrangement of the present invention, there are provided two separate, parallel arrangements of the heat storage agent of the second stage, and these arrangements may be operated alternately. That is, as soon as a first heat storage agent arrangement is substantially completely used up, i.e. such that the temperature of such agent rises with the result that conditioned air passing therethrough will not be cooled thereby, the system may be switched over to the second heat storage agent arrangement which then is used during the air conditioning operation. At such time, the first heat storage agent arrangement again is cooled down by passing therethrough environmental air or other cooled air, after which the first arrangement again is ready for use in the air conditioning operation. This makes it possible to reduce the volume of heat storage agent required in an overall system, since the complete system no longer is required to have a single arrangement of heat storage agent sufficient to provide satisfactory air conditioning for an entire day. Rather, the heat storage agent arrangements of the second stage can be designed such that switching may take place regularly, for example every hour, whereby one arrangement is used for air conditioning and at the same time the other arrangement is regenerated by being cooled. It of course is to be understood that it is contemplated within the scope of the present invention to provide a number greater than two of the parallelly arranged heat storage agent units.

In a further advantageous version of the present invention, there are provided two parallel systems, each system comprising the above discussed first, second and third stages. While one system is being employed for air conditioning, the other system may be operated in a reverse flow direction and may be regenerated. It of course is to be understood to be within the scope of the present invention that a number of systems more than two may be provided.

In accordance with another preferred version of the present invention, and particularly useful with certain climatic conditions, the first and second stages are serially repeated. That is, the air to be conditioned is passed through a first dry moisture storage agent, wherein most of the humidity of the humid environmental air is removed. This dried air then is cooled in a first heat storage agent, and then is passed through a second dry moisture storage agent whereat the water vapor content of the air is further reduced. During this second moisture reducing operation the temperature of the air again increases, and the air accordingly is passed through a second heat storage agent whereat the air temperature again is reduced. The air then is passed through the third stage discussed above. This version of the present invention is of particular advantage in a so-called "hot house" climate wherein the air is at a high temperature and a high relative humidity.

As mentioned above, preferable materials for use as the heat storage agent or medium are olivine or basalt materials. Such materials have a low heat conductivity and are available in a granular form, whereby the grain size usually will be between 1 mm and 10 mm.

In accordance with the present invention it is advantageous to use as the moisture storage agent or medium for the first stage, and for the third stage if such agent is employed, a zeolite or silica gel, preferably a silica gel having a relatively small pore size. It is believed that those of ordinary skill in the art, upon considering the present disclosure, will understand what pore sizes would be satisfactory for carrying out the present invention. There can be employed synthetic as well as natural zeolites which have a sufficiently high water absorption capacity. Synthetic zeolites are available commercially under the term or label of "molecular sieves".

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
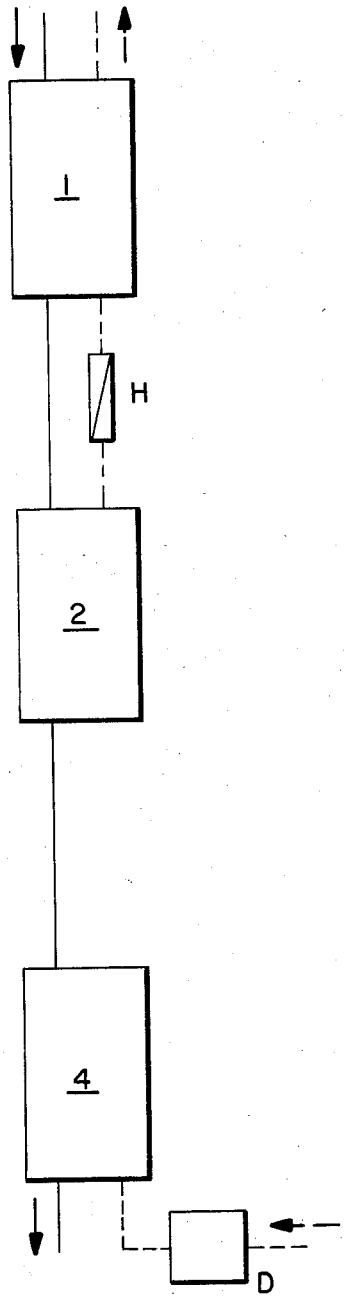
FIG. 1 is a flow diagram illustrating a basic first embodiment of the present invention.

In FIG. 1 there is illustrated a first embodiment of the present invention, and illustrated therein in diagramatic form only are the important elements of the present invention. It is to be understood that the various pipes, conduits, blowers, fans, control systems and heat exchange systems which would be incorporated into the various embodiments of the present invention are not illustrated as one of ordinary skill in the art would readily adapt such conventional features to the teachings and concepts of the present invention. Air to be conditioned, for example humid environmental air, is passed through a first stage 1, for example a container or column containing a substantially dry suitable moisture storage agent, for example silica gel with a small pore size. The passage of the air through such agent removes moisture from the air, such moisture being transferred to the agent, and increases the temperature of such air. This dried and somewhat heated air then is passed through a second stage 2, for example a container or a column containing a suitable heat storage agent or medium at an initial relatively low temperature, for example the temperature of the night air. By passage of the air through this heat storage agent, the air is cooled by transfer of heat to the agent. This occurs without affecting the humidity of the air. The thus cooled dry air then is passed through a third stage 4 and is humidified and additionally cooled. The third stage 4 may be a container containing water or a washing tower. Alternatively, the third stage 4 may be a container or column containing an initially water saturated moisture storage agent, which agent may be the same as the moisture storage agent employed in stage 1.

In summary, at the start of the air conditioning operation, humid environmental air having a particular degree of humidity and a particular temperature is drawn in from the atmosphere, enters first stage 1 and is completely dried by the dry moisture storage agent. As the air conditioning operation continues, the initially dry moisture storage agent increasingly becomes saturated with water. During this first stage, the temperature of the air is increased. The dried air passes from first stage 1 and enters second stage 2 wherein the heat absorbed during the first stage is transferred to the heat storage agent in the second stage. During the continuing air conditioning operation, the temperature of the heat storage agent increases, and specifically a higher temperature zone or front gradually moves through the heat storage agent. The dry cooled air passes from stage 2 and enters the third stage 4, which in the illustrated arrangement includes a moisture storage agent which at the beginning of an air conditioning operation is completely saturated with water. The dry air which has been cooled in the second stage takes up water from the water saturated moisture storage agent in the third stage, and at the same time the air is further cooled so that it has a substantially lower temperature upon leaving the third stage and can be utilized for air conditioning purposes. As indicated above, the third stage 4, instead of including a column containing an initially water saturated moisture storage agent, may consist of a water filled container or a spray column or water tower.

FIG. 1 illustrates diagramatically one manner in which the first stage 1 may be regenerated, i.e. dried after being saturated with water in a previous air conditioning operation. Thus, air can be passed through the second stage 2, thereby heating the air and cooling the agent of the second stage. This air is further heated by a suitable heating device H, and the air then is passed through the agent in first stage 1, thereby drying the agent in the first stage 1. By this operation, the first stage, as well as the second stage, may be regenerated. Further illustrated diagramatically in FIG. 1 is a manner in which the moisture storage agent of the third stage 4 may be regenerated. Thus, during a previous air conditioning operation, the moisture storage agent in the third stage 4 is dried. Air can be passed through the agent in third stage 4, and this air may be passed through water or a water sprinkling arrangement, shown at D. By this arrangement, the dry agent in the third stage 4 may again be saturated with water. By the above operations, the system shown in FIG. 1 again is ready for a new air conditioning operation.

Figure 2:
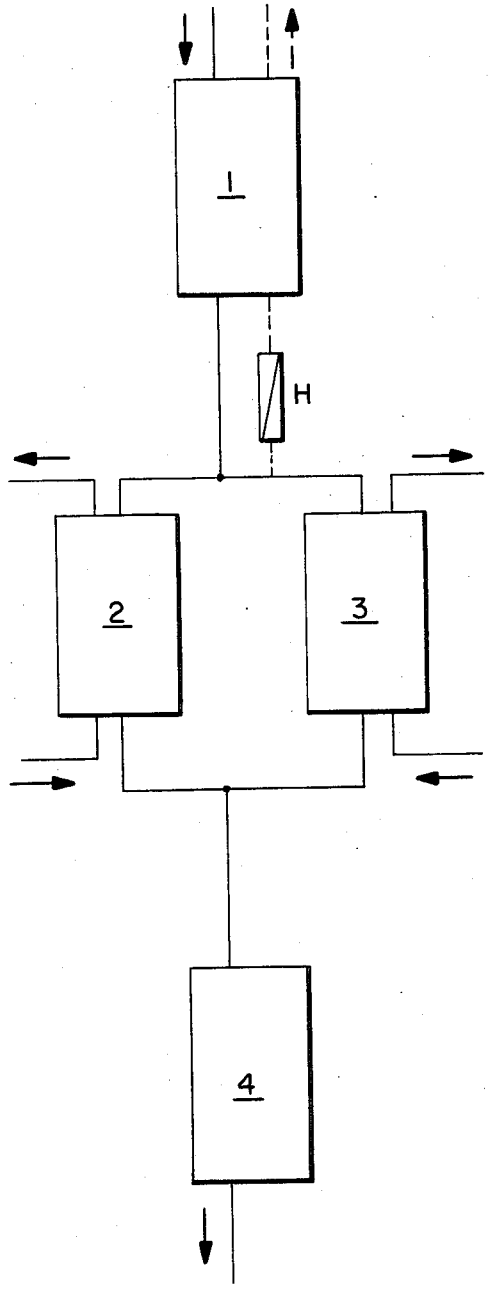
FIG. 2 is a flow diagram illustrating a second embodiment of the present invention employing two parallelly connected arrangements of heat storage agent or medium.

FIG. 2 illustrates a second embodiment of the present invention. This embodiment is similar to the embodiment of FIG. 1, except that the second stage consists of two separate, parallel arrangements 2, 3 of heat storage agent, for example provided in respective containers or columns. These separate second stages 2, 3 are intended to be operated alternately. Thus, while one second stage, for example second stage 2, is being operated during an air conditioning operation, the other second stage 3 may be regenerated. When the heat storage agent of the second stage 2 becomes heat saturated, such that the air passing through is not satisfactorily cooled, the system may be switched to second stage 3 for continuation of the air conditioning operation, and second stage 2 then may be regenerated. Regeneration of the agent in stages 2, 3 is illustrated in FIG. 2 only by arrows.

Figure 3:
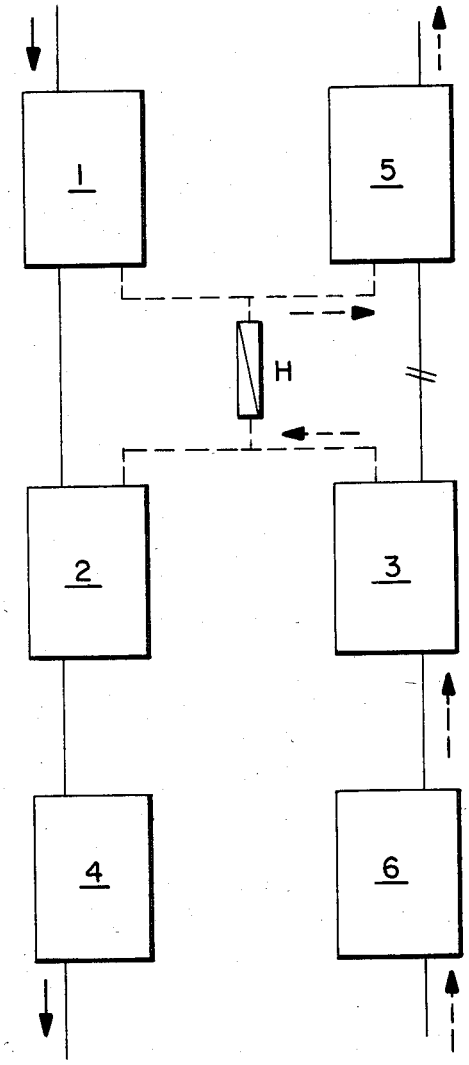
FIG. 3 is a flow diagram illustrating a third embodiment of the present invention employing two parallel air conditioning systems.

FIG. 3 illustrates a third embodiment of the present invention where there are provided two parallel systems, each such system including first, second and third stages as discussed above regarding the embodiment of FIG. 1. Thus, one system in FIG. 3 includes a first stage 1, a second stage 2 and a third stage 4. The other system in FIG. 3 includes a first stage 5, a second stage 3 and a third stage 6. While one system is being operated for air conditioning, the other system may be undergoing regeneration. In the arrangement illustrated diagramatically in FIG. 3, the left system is being employed to carry out an air conditioning operation, and the right system is undergoing regeneration. Thus, when the air conditioning capacity of one system is exhausted, the arrangement is switched to the other parallel system to continue air conditioning, while the first system then is regenerated.

Figure 4:
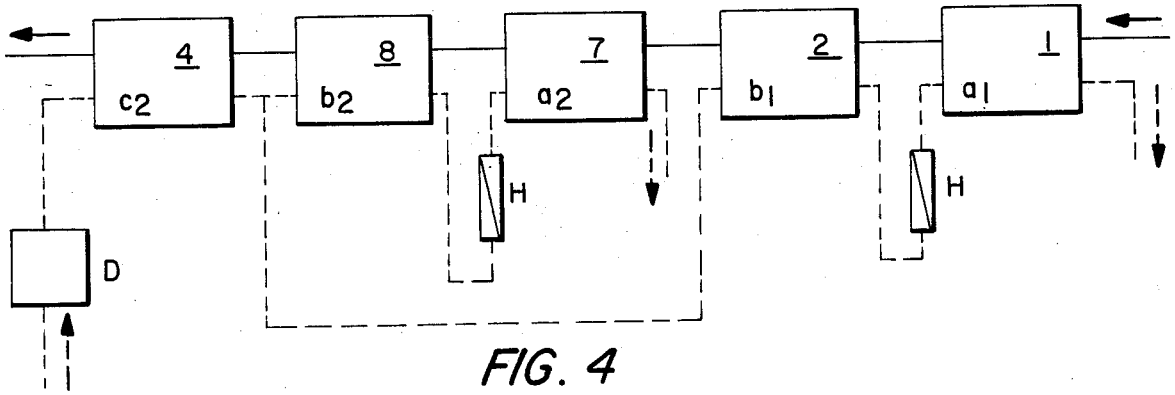
FIG. 4 is a flow diagram illustrating a fourth embodiment of the present invention employing a serially connected arrangement wherein the first and second stages are repeated.

FIG. 4 illustrates a fourth embodiment of the present invention wherein, after the air is dried in first stage 1 and cooled in second stage 2, the air then again is dried in another first stage 7 and cooled in another second stage 8 before it is passed to the third stage 4. In other words, in this embodiment of the present invention there is provided a first moisture storage agent $a_1$, a first heat storage agent $b_1$, a second moisture storage agent $a_2$ and a second heat storage agent $b_2$. In the illustrated arrangement of this embodiment of the present invention, the third stage 4 includes an initially water saturated moisture storage agent $c_2$. This embodiment is of particular advantage for a so-called hot house climate, wherein the air to be conditioned has a high temperature and a high moisture content. For example, humid environmental air, for example at a relatively high temperature of approximately 30° C. and a high relative humidity of approximately 100%, enters the initial first stage 1 and is dried. The air then passes through the initial second stage 2 and is cooled. Subsequently, the air then is passed through the other first stage 7 and is even further dried and then passes through the other second stage 8 to be even further cooled. The air then passes through the third stage 4 where it absorbs water and is even additionally cooled.

On the basis of initial orientation tests and subsequent calculations, it may be expected that the following air conditioning affects can be achieved with the use of the present invention. Employed are a silica gel with small pores and a maximum water absorption capacity of 39.4% by weight of its own dead weight as the moisture storage agents of the first and third stages, and a basalt material for the heat storage agent of the second stage.

EXAMPLE 1

This example is carried out in accordance with the diagram shown in FIG. 1. Humid environmental air has a temperature of 30° C. and a relative humidity of $r=50\%$. At the start, the silica gel in first stage 1 is for the most part dry, with a residual water content of $c_i=0.08$ (kg $H_2O$/kg silica gel). After the air is passed through first stage 1, the temperature has risen to 55° C. In the heat storage agent of second stage 2, the temperature of the air is reduced to 30° C. Then the air is passed through a fully water saturated silica gel in stage 4, with a water content of $c_i=39.4$. After the conditioned air leaves the silica gel in stage 4, the temperature of the air is 15.9° C.

EXAMPLE 2

This example is carried out in accordance with the diagram of FIG. 4. Environmental air has a temperature of 30° C. and a relative humidity of $r=50\%$. The silica gel in stages 1 and 7 has a water content of $c_i=0.08$. After the air has passed through first stage 1, the temperature is 55° C. After passage through second stage 2, the temperature of the air is lowered to 30° C. The air at this temperature then passes through the other first stage 7 and leaves therefrom at a temperature of 45° C. By passing through the other second stage 8, the temperature of the air again is reduced to 30° C. During subsequent passage through fully water saturated silica gel in third stage 4, the temperature of the air is lowered to 11.6° C due to water absorption.

EXAMPLE 3

In this example, the operation of Example 1 is repeated. However, the initial humid environmental air has a temperature of 30° C. and has a relative humidity of $r=100\%$, that is the humid environmental is so-called hot house air. After flowing through the silica gel in stage 1, the air temperature is 66.3° C., and after passing through the water saturated silica gel of third stage 4, the temperature of the air is lowered only to 23.9° C.

EXAMPLE 4

The operation of Example 2 was repeated. However, the environmental air has a temperature of 30° C. and a relative humidity of $r=100\%$. After flowing through the silica gel in first stage 7, the temperature is increased to 58.5° C., and after leaving the water saturated silica gel of third stage 4, the final temperature is 15.2° C.

EXAMPLE 5

This example will involve an explanation of the manner of regeneration of the more or less water saturated storage agent in first stage 1 and/or 7, following a previous air conditioning operation. Thus, it has become apparent that when employing silica gel as the agent of the first stage 1 and/or 7, it is sufficient to have a temperature of the regeneration air of 70° C. with environmental air at a temperature of 30° C. and having a relative humidity of $r=50\%$, or a regeneration air temperature of 80° C. with environmental air of 30° C. and a relative humidity of $r=100\%$, to completely or substantially completely dry water saturated silica gel to a minimum water content of $c_i \leqq 0.08$. That is, such conditions will regenerate such previously water saturated silica gel so that it again can be used as a dry moisture storage agent during a subsequent air conditioning operation. In accordance with the present invention, it is possible to employ heat retained in the heat storage agent of second stage 2 and/or 8 for the regeneration of the first stage 1 and/or 7. For example, with regard to Examples 1 and 2, for which air flows in a direction opposite to that during the air conditioning operation through the heat storage agent during a regeneration operation, such air will leave the heat storage agent at a temperature of 55° C. so that it has to be heated up additionally, for example by a suitable heater, to a suitable temperature level of 70° C. and/or 80° C. By suitable control, it is possible to adjust easily the necessary temperature for a given operation based upon the respective temperature and humidity conditions involved. In the case of Examples 3 and 4, the temperature of the air leaving the heat storage agent during regeneration is even higher, i.e. as high as 66.3° C., so that a smaller amount of additional heat is needed to achieve the necessary regeneration temperature for the respective first stage, i.e. 70° C. and/or 80° C. By the use of the heat from the heat storage agent, it is possible to recover most of the heat required for regeneration, so that the present invention may be carried out in a economic manner.

The present invention has the further advantage that it can be carried out with air from the environment with a relative humidity of 100%, independent of the particular temperature of such air. This contrasts with known air conditioning techniques which utilize water absorption by air to achieve cooling, and wherein the operation becomes impossible or shows only poor results with completely or substantially completely saturated air. In accordance with the present invention however, it is possible to achieve a substantial temperature reduction, particularly when employing the embodiment of FIG. 4 wherein there are provided serially connected two first stages and two second stages.

Although the present invention has been described and illustrated with regard to preferred features thereof, it is to be understood that various modifications may be made to the specifically described and illustrated features without departing from the scope of the present invention.

I claim:

1. A method of reducing the temperature of humid environmental air, said method comprising:

providing in series connection a first moisture storage agent, a first heat storage agent, a second moisture storage agent and a second heat storage agent;

passing said air serially through said agents and thereby:

passing said air through said first moisture storage agent and therein substantially reducing the moisture content of said air;

passing said air through said first heat storage agent and therein lowering the temperature of said air without changing the humidity thereof;

passing said air through said second moisture storage agent and therein substantially freeing said air of the remaining moisture content thereof; and passing said air through said second heat storage agent and therein further lowering the temperature of said air without changing the humidity thereof; and then passing said air through a water saturated moisture storage agent and therein increasing the moisture content of said air and further lowering the temperature thereof.

2. A method as claimed in claim 1, wherein said heat storage agent comprises olivine or a basalt material.

3. A method as claimed in claim 1, wherein said moisture storage agent comprises zeolite or silica gel.

4. An apparatus for reducing the temperature of humid environmental air and for use with a blower and piping system for conveying the air, said apparatus comprising:

a first moisture storage agent for receiving humid environmental air and for substantially reducing the moisture content thereof;

a first heat storage agent for receiving said air from said first moisture storage agent and for lowering the temperature of said air without changing the humidity thereof;

a second moisture storage agent for receiving said air from said first heat storage agent and for substantially freeing said air of the remaining mosisture content thereof;

a second heat storage agent for receiving said air from said second moisture storage agent and for further lowering the temperature of said air without changing the humidity thereof; and a water saturated moisture storage agent for receiving said air from said second heat storage agent and for increasing the moisture content of said air and further lowering the temperature thereof.

5. An apparatus as claimed in claim 4, wherein said heat storage agent comprises olivine or a basalt material.

6. An apparatus as claimed in claim 4, wherein said moisture storage agent comprises zeolite or silica gel.

* * * * *